US006029738A

United States Patent [19]

Matuura et al.

[11] Patent Number: 6,029,738

[45] Date of Patent: Feb. 29, 2000

[54] CORE FOR USE IN DIE CASTING PROCESS

[75] Inventors: Fujihiro Matuura, Yokohama; Kazuo Sasaki, Yokosuka; Masashi Sano, Yokohama, all of Japan

[73] Assignee: Kioritz Corporation, Tokyo, Japan

[21] Appl. No.: 09/079,393

[22] Filed: May 15, 1998

[30] Foreign Application Priority Data

May 16, 1997 [JP] Japan ..... 9-126742

[51] Int. Cl.[7] ..... B22C 9/10; B22C 9/12

[52] U.S. Cl. ..... 164/369; 164/34; 164/36; 164/5

[58] Field of Search ..... 164/369, 34, 36, 164/5

[56] References Cited

U.S. PATENT DOCUMENTS

| | | | |
|---|---|---|---|
| 3,817,459 | 6/1974 | Keller et al. | 241/20 |
| 3,852,232 | 12/1974 | Bowman et al. | 263/29.3 |
| 4,042,410 | 8/1977 | Ito | 106/117 |
| 4,129,000 | 12/1978 | Umeda et al. | 60/361 |
| 4,747,573 | 5/1988 | Nagashima | 164/369 |
| 5,667,191 | 9/1997 | Nemoto | 249/61 |
| 5,702,628 | 12/1997 | Nemoto | 164/369 |

FOREIGN PATENT DOCUMENTS

| | | | |
|---|---|---|---|
| 8-71689 | 9/1984 | Japan | 164/369 |
| 8-90155 | 9/1994 | Japan | 164/369 |
| 8-126742 | 12/1997 | Japan . | |

*Primary Examiner*—Patrick Ryan
*Assistant Examiner*—Anjan Dey
*Attorney, Agent, or Firm*—Thelen Reid & Priest, LLP

[57] ABSTRACT

A core for use in a die casting process has a wood fiber material as a main ingredient. The core can be disintegrated by exerting an external force subsequent to the die casting process. The core can also be disintegrated by applying a softening agent to soften it subsequent to the die casting process. Further, the core can be made up of a stack of paper layers that are peelably removable from each other.

16 Claims, 4 Drawing Sheets

CORE FOR USE IN DIE CASTING PROCESS

BACKGROUND OF THE INVENTION

1. Field of the Invention

The present invention relates to a core for use in a die casting process.

2. Related Art

Conventionally,it is known to use a shell core to form a cavity in an object formed by a die casting process, particularly, in a low pressure casting process in which molten metal is forced into a die under relatively low pressure. Generally, foundry sand is the material used for forming the shell core. The foundry sand is mixed with a synthetic resin binder, and is heated to form the shell core. Such a shell core is formed to retain its shape under the low pressure during the low pressure die casting process, but is disintegrable by an external force or vibrations applied subsequent to the die casting process to facilitate its removal.

However, this shell core has several problems. For example, its manufacturing process is time-consuming and complex, and causes dust and odor to be created.

Therefore, an object of the present invitation is to provide a core that is made of a material other than the foundry sand that is used conventionally, so as to avoid the aforementioned problems. It is a further object of the present invention to provide a core that is durable during the die casting process conducted under relatively high pressure, and that is easy to handle.

SUMMARY OF THE INVENTION

The invention provides that wood fiber materials are used as a main component of a core used for a die casting process. The wood fiber materials include, for example, paper, pulp, wood particles, wood powder, wood chips, or the like.

It was found by the inventors of present invention that cores for use in the die casting processes made of wood fiber materials retain their shape during the die casting process without burning at the high temperature of molten metal. Therefore, an object of the present invention can be achieved by using a core for use in a die casting process having a wood fiber material as a main ingredient.

Furthermore, another object of the present invention can be achieved by another aspect of the invention, which is a core for use in a die casting process for forming a straight bore and an undercut portion that is in communication with the bore. The core has a core body for forming the bore, and an undercut core for forming the undercut portion. The undercut core is attached to the core body so as to be separable by a shear force applied when the core body is withdrawn from the bore. At least the undercut core has a wood fiber material as a main ingredient, and is disintegrable by applying an external force or applying a softening agent thereto, subsequent to the die casting process.

When the core body is withdrawn from the casting after the die casting process, the undercut core is separated from the core body by a shear force caused by the withdrawal of the core body, and is left in the undercut portion of the casting. The undercut core can be disintegrated and removed through the bore formed by the core body by applying an external force, or it may be further heated subsequent to the die casting process to carbonize it so that it becomes brittle. Alternatively it may be softened or dissolved by an agent for easy removal. In the preferred embodiment, first, the core body is pulled from the outside and is integrally withdrawn; then the bore formed thereby is utilized as a path to access the undercut core. The undercut core can be removed by the means as mentioned above.

Further, in accordance with a preferred embodiment, the core can be disintegrated by exerting an external force subsequent to the die casting process. The core can be disintegrated by, for example, applying a force directly thereto, so as by scratching it. This facilitates removal of the core. Alternatively, the core may be heated in an annealing process subsequent to the die casting process, to carbonize it to make it brittle so that it can be broken into pieces for removal.

Furthermore, in accordance with a preferred embodiment, the core can be disintegrated by applying a softening agent to soften it subsequent to the die casting process. The entire casting may be immersed into an appropriate agent, or an agent may be injected into the core to permeate it, so that the core is softened or dissolved to facilitate its removal. This enables easy removal of the core from a passage located far inside, or a small cavity with a small opening through which it is difficult to make access.

Furthermore, in accordance with a preferred embodiment, the core is a stack of paper layers that are peelably removable from each other. Therefore, the core can be easily removed by peeling the layers by applying an external force or by applying an agent.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
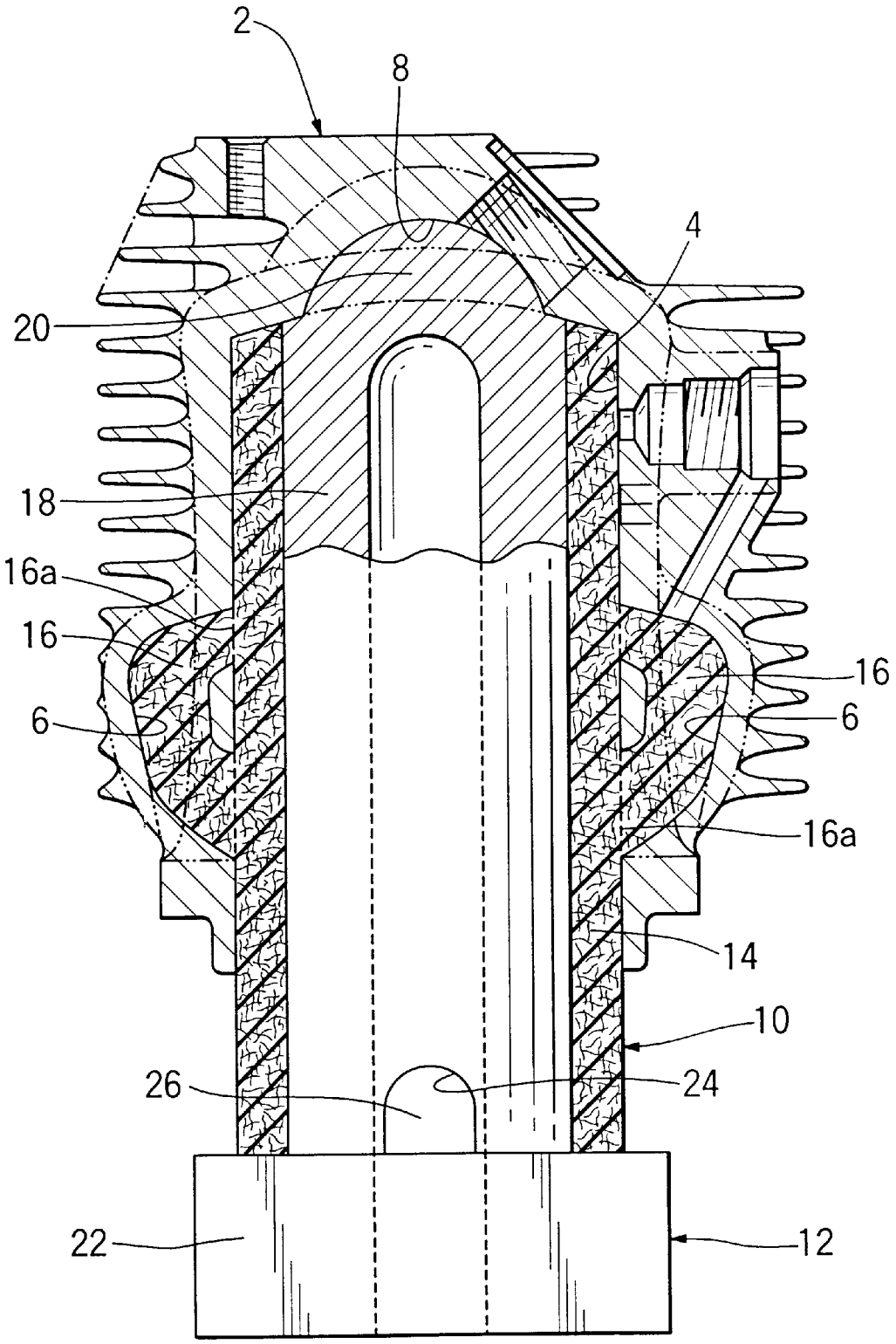
FIG. 1 is a longitudinal cross-sectional view of a disintegrable core for use in a die casting process, a slide core and a cylinder block formed thereby.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The invention provides that wood fiber materials can be used as a main component of a core used for a die casting process. Wood fiber materials include, for example, paper, pulp, wood particles, wood powder, wood chips, or the like.

Testing conducted by the inventors of the present invention proves that a core for use in die casting processes made of wood fiber materials retains its shape during the die casting process without burning at the high temperature of molten metal. It is thought the reason for this is that, since the heat conductivity of the wood fiber materials is low, the molten metal contacting the wood fiber materials instantaneously solidifies. Further, another reason may be that the molten aluminum fills the space between the die forming the casting and the core under pressure so that no unfilled areas are left in a short period of time, so that the oxygen surrounding the core is ejected.

The core for use in the die casting process in accordance with the present embodiment can be utilized for forming a cavity in any objects manufactured by a die casting process. However, in the illustrated embodiment, a core for use in manufacturing a cylinder block of a compact, air-cooled, two-stroke-cycle internal combustion engine of 25 cc displacement by a die casting process is described as a non-limiting example.

As shown in FIG. 1, a cylinder block 2 of the air-cooled, two-stroke cycle internal combustion engine has a cavity including a bore (or cylinder) 4, undercut portions (or scavenging passages) 6, and a combustion chamber 8. The cavity is formed by a combination of a paper core 10 and a metal sliding core 12.

Figure 2:
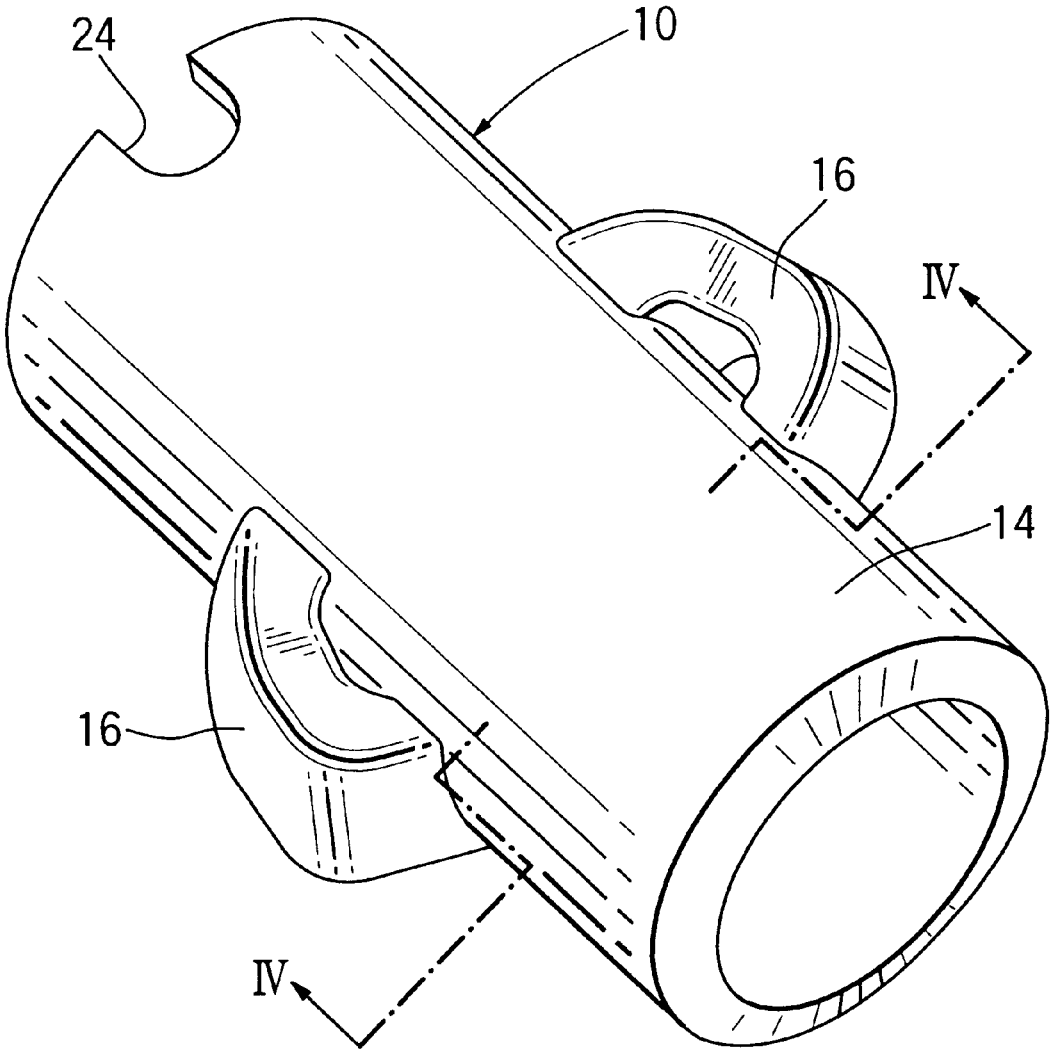
FIG. 2 is a perspective view of the entire disintegrable core.

As can be seen with reference to FIG. 2, the paper core 10 has a hollow cylindrical core body 14 for forming the cylinder 4, and ear portions 16 that are attached to a side wall surface of the core body 14 for forming the scavenging passages 6. As depicted in FIG. 1, the metal sliding core 12 has a longitudinally-extending cylindrical portion 18 that fits into the core body 14 of the paper core 10, a substantially semi-spherical portion 20 that projects upwardly from an upper extremity of the cylindrical portion 18 and is for forming the combustion chamber 8, and a base plate 22 provided at the base of the cylindrical portion 18. An indentation 24 is formed at the base of the cylindrical portion 18, and a projection 26 whose shape corresponds to the indentation 24 is provided at the base of the cylindrical portion 18 of the sliding core 12. The indentation 24 and projection 26 are aligned with each other to prevent relative rotation.

Figure 3:
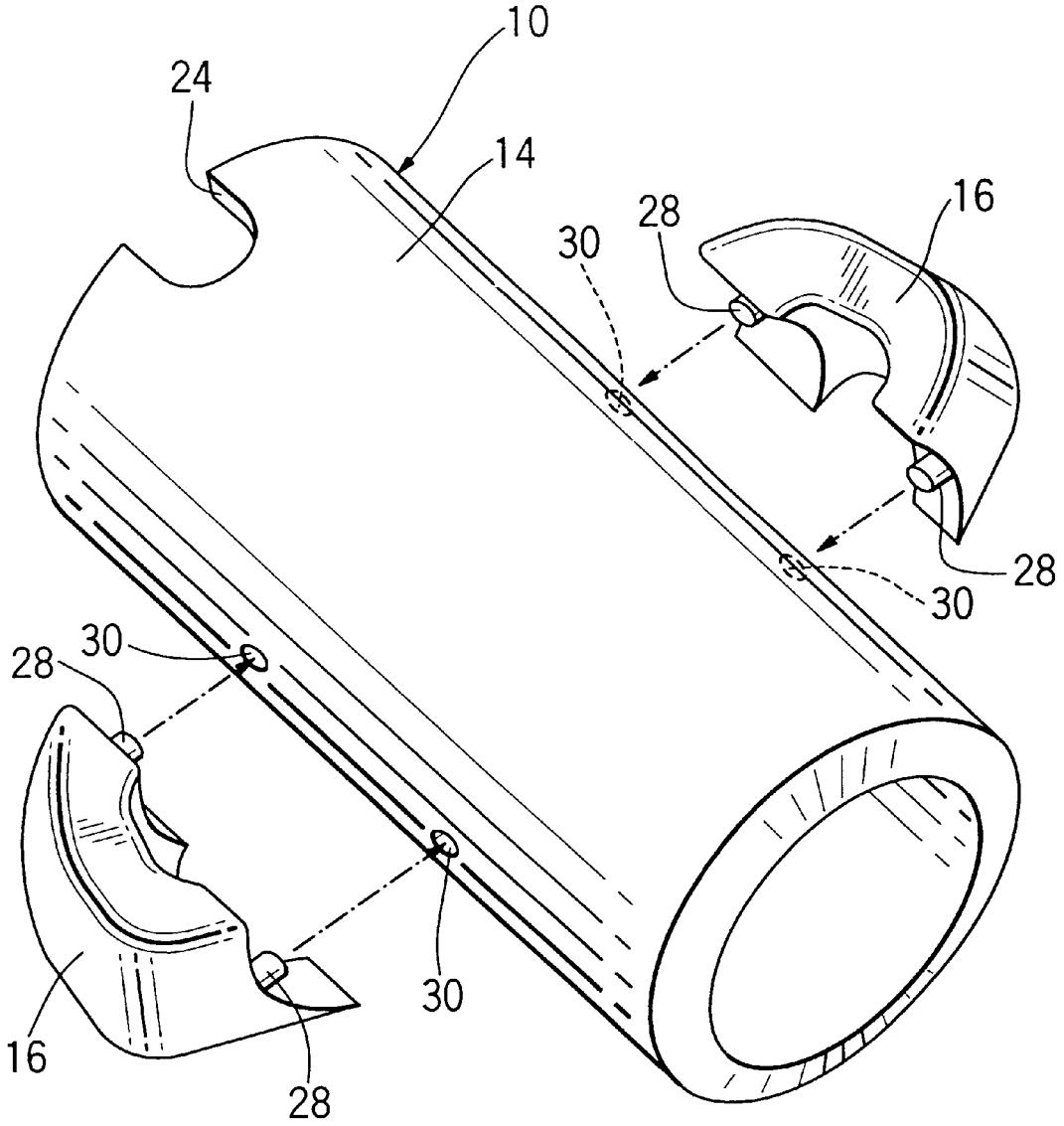
FIG. 3 is an exploded perspective view of ear portions and a core body of the disintegrable core made of paper.

Referring now to FIG. 3, the ear portions 16 are made of a stack of thin paper, each layer of which is oriented in an elongated direction of core body 14. The orientation of the paper layers may be determined based on the shape of the cavity so that the ear portions 16 can be easily peeled and removed therefrom after a die casting process.

The core made of the stacked layers can be formed by, for example, a high speed three-dimensional object manufacturing machine, such as Model Nos. LOM-2030H and LOM-1015®, available from Toyoda Koki, located in Tokyo Japan. It is made by applying a heat-hardening adhesive to LOM paper®, which is a composite of hard paper and resin. The paper layers are stacked and bonded to each other by applying pressure by thermal rollers.

Alternatively, the core of the stacked layers can be formed by a machine called Solid Center, for example, Model No. KSC-50 available from Kira Corporation located in Tokyo, Japan. The core of the stacked layers is made of ordinary papers that are pressed against each other by a hot pressing process to bond them to each other.

As a further alternative, the core of the stacked layers may also be made by the process disclosed in Japanese patent laid-open disclosure no. 8-318575, or by any other conventional process.

The paper material does not burn at the high temperature of molten aluminum alloy, and its shape is retained during the die casting process. It is thought that the reason for this is that the heat conductivity of the paper material is low, and therefore the molten aluminum alloy that is in contact with the outer surface of the paper core 10 whose main component is the paper material, instantaneously solidifies. More particularly, the surface of the molten aluminum alloy usually solidifies in approximately 1 second or less. Further, another reason may be that molten aluminum alloy fills the space between a die (not shown) for forming the outer contour of the cylinder block 2 and the paper core 10, so that no unfilled areas are left, and molten aluminum alloy is forced therebetween in a short period of time under pressure, so that oxygen surrounding the paper core 10 is ejected.

The stacked paper layers formed as mentioned above do not peel from each other, even under the relatively high pressure. Therefore, each of the ear portions 16 is not disintegrated during the die casting process. That is, it can retain its shape under pressure during the die casting process in which molten metal is forced into the die under the relatively high pressure. After the die casting process, an operator can scratch the ear portions 16 by suitable means, such as fingers or a stick, so as to peel the paper layers. This enables easy removal of the ear portions 16 from the cylinder block 2.

The ear portions 16 formed as mentioned above meet the dimensional accuracy required to form the scavenging passages 6 in the cylinder block 2. The paper layers used for the paper core preferably contain little water, to maintain the accuracy of its original shape of the core during the die casting process.

The core body 14 is formed in the cylindrical shape by a widely known method, for example, by rolling thick paper so that it cannot be easily disintegrated by external force.

Figure 4:
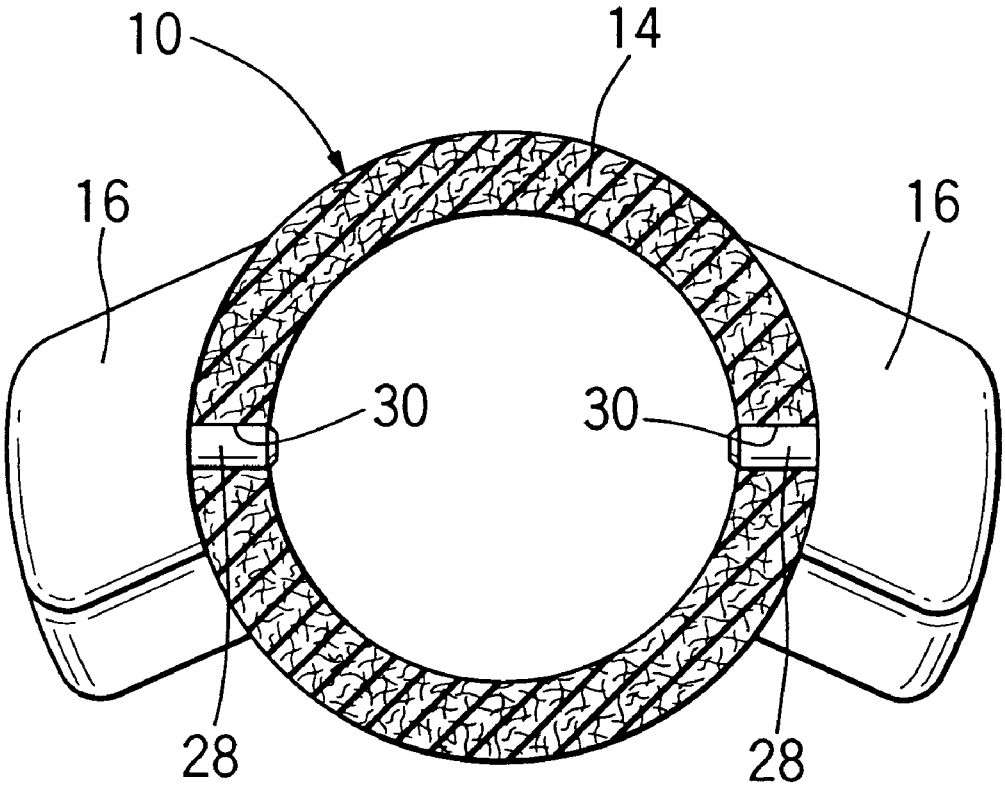
FIG. 4 is a cross-sectional view taken along a line IV—IV shown in FIG. 2, showing attachment of the ear portions to the core body.

As clearly shown in FIGS. 3 and 4, the ear portions 16 have knockout pins 28 formed on surfaces that allow the ear portions 16 to be mounted to the core body 14. The knockout pins 28 are integrally formed on the ear portions, with the same paper material as that of the ear portions 16. The wall of the core body 14 has corresponding holes 30 for receiving the knockout pins 28, so that the ear portions 16 and the core body 14 can be aligned. The ear portions 16 are bonded to the side wall surface of the core body 14 by an adhesive.

The die casting process is carried out by utilizing the paper core 10 and the slide core 12 in accordance with the steps described hereinafter.

First, the slide core 12 is inserted into the core body 14 of the paper core so that the projection 26 is aligned with the indentation 24. Then, the sliding core 12 and core body 14 are fixed at a predetermined location within the die (not shown) for forming the outer contour of the cylinder block 2. Molten aluminum alloy is forced into the die under pressure.

When the molten aluminum alloy has solidified, the die is removed and the slide core 12 is withdrawn from the paper core 10. Further, the core body 14 of the paper core 10 is pulled to be withdrawn in the elongated direction, When the core body 14 is pulled, the knockout pins 28 are easily torn, together with the paper material surrounding the knockout pins 28, by a shearing force generated by the withdrawal of the core body 14. This causes the ear portions 16 to be separated from the core body 14 and to be left within respective cavities of the scavenging passages 6.

Subsequently, the operator inserts fingers or a stick into the cylinder 4 formed by the core body 14, and scratches the stacked paper layers constituting the ear portions 16 in order to peel and remove them until they are completely removed from the scavenging passages 6. Alternatively, the core body 14 and ear portions 16 may be further heated in an annealing process subsequent to the die casting process to carbonize the ear portions 16 to make them brittle so that they can be broken into pieces for removal.

Furthermore, in another removal method, the entire cylinder block 2 can be immersed in an appropriate releasing agent to weaken the tack strength between the paper layers so that they can be easily removed.

As still another alternative, the cylinder block 2 may be immersed in a softening agent, or this agent may be injected into the ear portions 16 through the cylinder 4, to permeate the agent therein, to enable the ear portions 16 to be removed.

The paper core 10 of the present embodiment can be utilized for high pressure die casting processes because it retains its shape under relatively high pressure.

In accordance with the paper core 10 of the present embodiment, since each of the ear portions 16 is constituted by a stack of paper layers that are disintegrable, removal of the ear portions 16 after the die casting process through the passages 6 having poor accessibility is facilitated.

Further, since the core body 14 is integrally formed by rolling thick paper into the cylindrical shape according to well-known conventional methods, the core body 14 can be integrally withdrawn from the cylinder 4. Integral removal of the core body 14 in this manner in one step enables access to the ear portions 16 to be formed through the cylinder 4, and the ear portions 16 are easily removed.

The present invention has been shown and described with reference to specific embodiments. However, it should be noted that the present invention is in no way limited to the details of the described arrangements, but changes and modifications may be made without departing from the scope of the appended claims.

For example, in the aforementioned embodiment, the ear portions are made of the thin paper layers. However, they can be formed of any wood fiber materials, including pulp, wood particles, wood powders, wood chips, or the like. The wood fiber materials may be shaped to conform to the shape of the paper core, by for example Techno Mold® available from Tomoku, Inc. located in Saitama Prefecture, Japan, or a pulp molding process carried out by Ohishi Sangyo, Inc. located in Fukuoka Prefecture, Japan. The paper core manufactured by the pulp molding process satisfactorily meets tolerance requirements for manufacturing cores to be used for the die casting process. Further, it can be softened for easy removal by a well known and commercially available agent used in a paper recycling process. Alternatively, it can be severed into pieces by a tool such as a cutter. The wood fiber materials may be formed to conform to the shape of the paper core by using binders or adhesives that do not generate toxic gas at a high temperature during the die casting process.

Furthermore, the ear portions 16 can be formed by bonding the paper layers by any other process than those described herein that assure the bonding strength between the paper layers to the extent that the core is durable under the high pressure die casting process.

Furthermore, in the above-mentioned embodiment, the core body 14 is made by rolling thick paper into a cylindrical shape by a conventional well-known method. However, the entire core 10, including the core body 14 and the ear portions 16, may be formed by stacking thin paper layers. In this case, perforations 16*a* (FIG. 1) are preferably formed for easy separation of the core body 14 from the ear portions 16.

Thus, modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A core for use in a die casting process, wherein the core comprises:

a stack of paper layers that are peelably removable from each other, the stack of paper layers comprising a wood fiber material as a main ingredient; and wherein the core is disintegrable by exerting an external force thereon after the die casting process.

2. A core for use in a die casting process, wherein the core comprises:

a stack of paper layers that are peelably removable from each other, the stack of paper layers comprising a wood fiber material as a main ingredient; and wherein the core is disintegrable by application of a softening agent after the die casting process.

3. A core for use in a die casting process, wherein the core comprises:

a stack of paper layers that are peelably removable from each other, the stack of paper layers comprising a wood fiber material as a main ingredient.

4. The core for use in the die casting process as recited in claim 1, wherein:

the wood fiber material includes pulp.

5. The core for use in the die casting process as recited in claim 1, wherein:

the wood fiber material includes wood particles.

6. The core for use in the die casting process as recited in claim 1, wherein:

the wood fiber material includes wood powders.

7. The core for use in the die casting process as recited in claim 1, wherein:

the wood fiber material includes wood chips.

8. A core for use in a die casting process for forming a straight bore and an undercut portion that is in communication with the bore, the core comprising:

a core body for forming the bore; and an undercut core for forming the undercut portion, the undercut core being attached to the core body so as to be separable from the core body by a shear force applied when the core body is withdrawn from said bore;

wherein at least the undercut core comprises a stack of paper layers that are peelably removable from each other and that have a wood fiber material as a main ingredient, and is disintegrable by application of an external force or a softening agent subsequent to the die casting process.

9. The core for use in the die casting process as recited in claim 2, wherein:

the wood fiber material includes pulp.

10. The core for use in the die casting process as recited in claim 2, wherein:

the wood fiber material includes wood particles.

11. The core for use in the die casting process as recited in claim 2, wherein:

the wood fiber material includes wood powders.

12. The core for use in the die casting process as recited in claim 2, wherein:

the wood fiber material includes wood chips.

13. The core for use in the die casting process as recited in claim 3, wherein:

the wood fiber material includes pulp.

14. The core for use in the die casting process as recited in claim 3, wherein:

the wood fiber material includes wood particles.

15. The core for use in the die casting process as recited in claim 3, wherein:

the wood fiber material includes wood powders.

16. The core for use in the die casting process as recited in claim 3, wherein:

the wood fiber material includes wood chips.

* * * * *